US006035972A

United States Patent [19]

Beattie

[11] Patent Number: 6,035,972

[45] Date of Patent: Mar. 14, 2000

[54] LIFT TABLE

[76] Inventor: John M. Beattie, 2014 19th Ave., Greeley, Colo. 80631

[21] Appl. No.: 09/055,976

[22] Filed: Apr. 6, 1998

[51] Int. Cl.[7] ..... B66F 9/06

[52] U.S. Cl. ..... 187/231; 187/244

[58] Field of Search ..... 187/233, 231, 187/234, 244, 240, 237; 414/785

[56] References Cited

U.S. PATENT DOCUMENTS 2,514,563 7/1950 Todd ..... 187/233
4,356,892 11/1982 Mossey ..... 187/231
5,848,668 12/1998 Kafrissen et al. ..... 187/231

*Primary Examiner*—Kenneth W. Noland
*Attorney, Agent, or Firm*—Dean P. Edmundson

[57] ABSTRACT

A portable lift table is described having a wheeled frame, a table with a workpiece support surface, and elevating means for selectively raising and lowering the table. The workpiece support surface may be positioned at two different heights relative to the elevating means. The table can be raised to a height greater than that of the mast of the apparatus. The lift table is useful for carrying a workpiece from the floor to a workbench or from low bench (or grinder) to workstation height. The table also preferably includes a roll gate to prevent objects from rolling off the end of the table.

3 Claims, 3 Drawing Sheets

LIFT TABLE

FIELD OF THE INVENTION

This invention relates to apparatus for lifting and carrying workpieces from one location to another. More particularly, this invention relates to portable or mobile tables.

BACKGROUND OF THE INVENTION

There are occasions in maintenance and repair operations when it is necessary to transfer or transport various items from one location to another (e.g, from the floor to a workbench or work station, or vice-versa). Sometimes it is also necessary to transport a workpiece or item from a large machine or apparatus to a work station(or vice-versa).

Conventional lift tables typically are limited in the range of vertical lift which they can provide. For example, a lift table may be able to raise items from ground level to workbench level, but the table would not be able to transfer items from ground level to a position above the height of the mast of the apparatus.

Also, a conventional lift table which involves a scissors mechanism for raising a table is inherently limited in how low the table can be positioned. Therefore, a lift table using a scissors-type mechanism is not readily able to lift items that are at or near the level of the floor.

There has not heretofore been provided a lift table which has the numerous advantages and features provided by the present invention.

SUMMARY OF THE PRESENT INVENTION

In accordance with the present invention there is provided a portable lift table which is convenient and easy to use. In a preferred embodiment the apparatus comprises:

(a) a wheeled frame which includes an upright mast means;

(b) elevating means carried by the frame;

(c) support means (e.g., a table) carried by the elevating means and including a workpiece support surface.

The support means is movable between upper and lower positions on the elevating means. The elevating means is adapted to selectively raise and lower the support means relative to the mast means.

Preferably the elevating means includes a slide which moves vertically relative to the mast, and the table or other support surface is carried by the slide. An electric actuator, powered by a DC motor and gear box, is adapted to selectively raise and lower the slide. The slide can be raised to a height greater than the height of the mast, thereby providing a wide range of vertical movement for the support surface.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
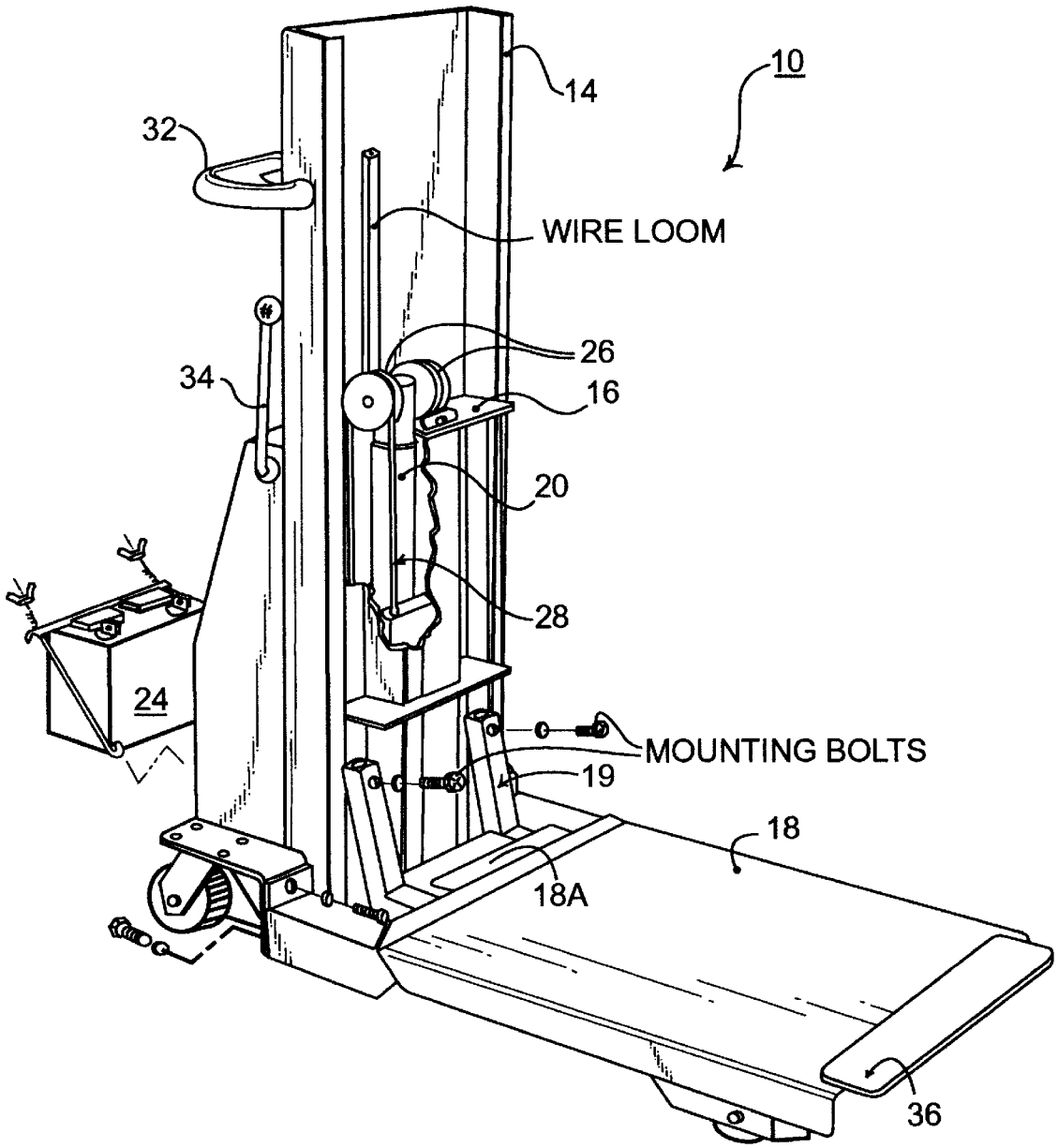
FIG. 1 is a front perspective view, partially cut away, of a preferred embodiment of lift table of this invention.

In the drawings there is shown a preferred embodiment of lift table 10 of the invention. The apparatus comprises a wheeled frame 12 having an upright mast 14 supported on the frame. A slide 16 is movable vertically in the mast, and a support means (shown here as table 18) is carried by the slide.

The slide is selectively caused to move upwardly and downwardly by means of a screw drive 20 powered by an electric motor and gear box 22. A battery 24 supplies the electrical power.

At the upper end of the screw drive electric actuator 20 there is at least one pulley 26. A cable 28 extends over the pulley. One end of the cable is secured to the mast and the opposite end is secured to the slide 16. Thus, as the screw is caused to rotate in one direction, the actuator is moved upwardly. The slide 16 is thereby moved upwardly by the cable at twice the distance of upward travel by the actuator. This feature enables the slide to be raised above the upper end of the mast (e.g., shown in FIG. 2).

The up/down switch 30 on the mast enables the operator to easily effect the desired upward or downward movement of the slide and the table from a safe position. Handle 32 enables the operator to move the apparatus to a desired location. A brake handle 34 controls vertical movement of brake pad 34A. Thus, when the apparatus is moved to a desired location, the brake handle can be pivoted downwardly to cause the brake pad to contact the floor. This prevents the apparatus from rolling in an undesirable manner.

Figure 2:
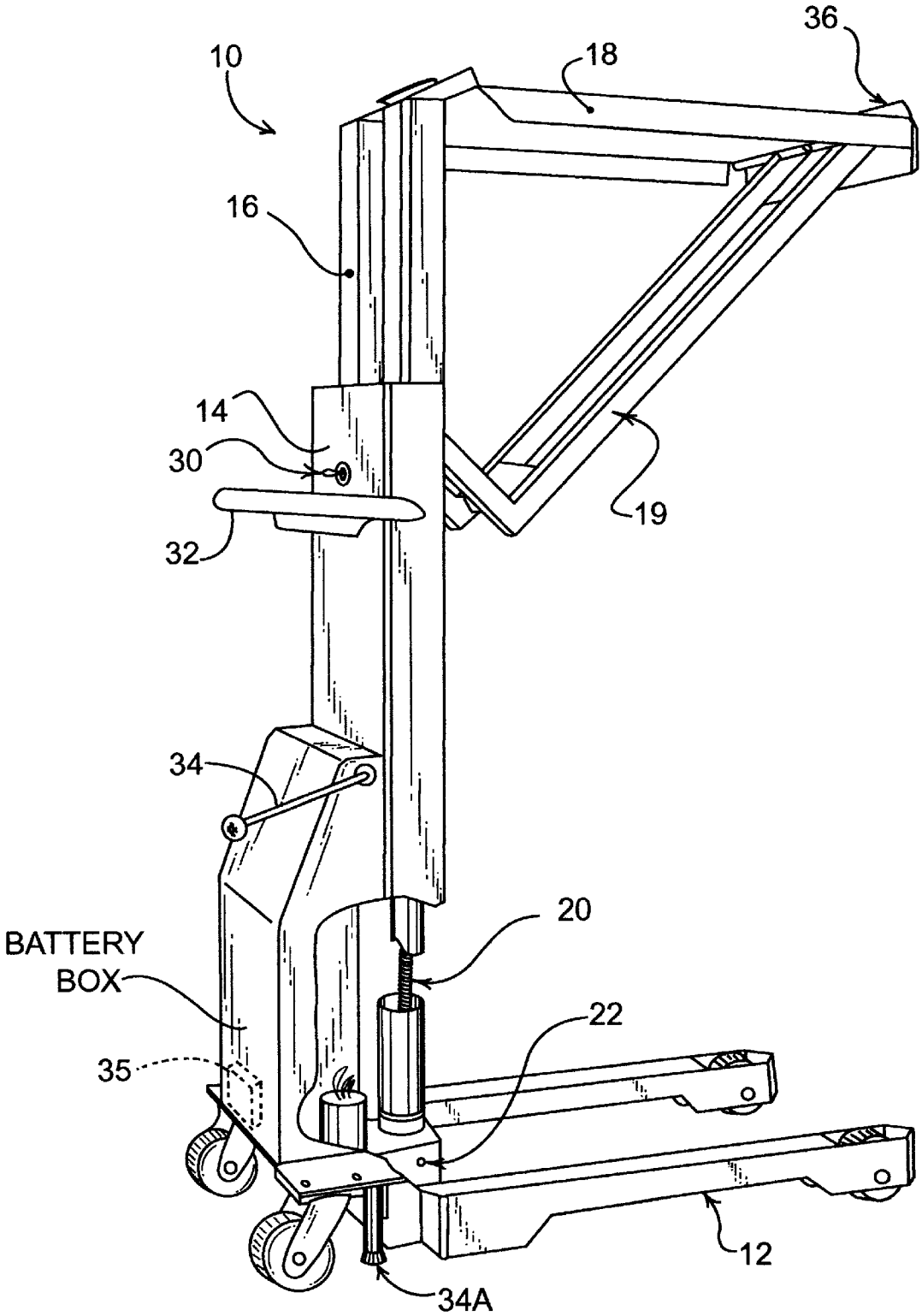
FIG. 2 is a rear perspective view, partially cut away, of the lift table shown in FIG. 1.
Figure 3:
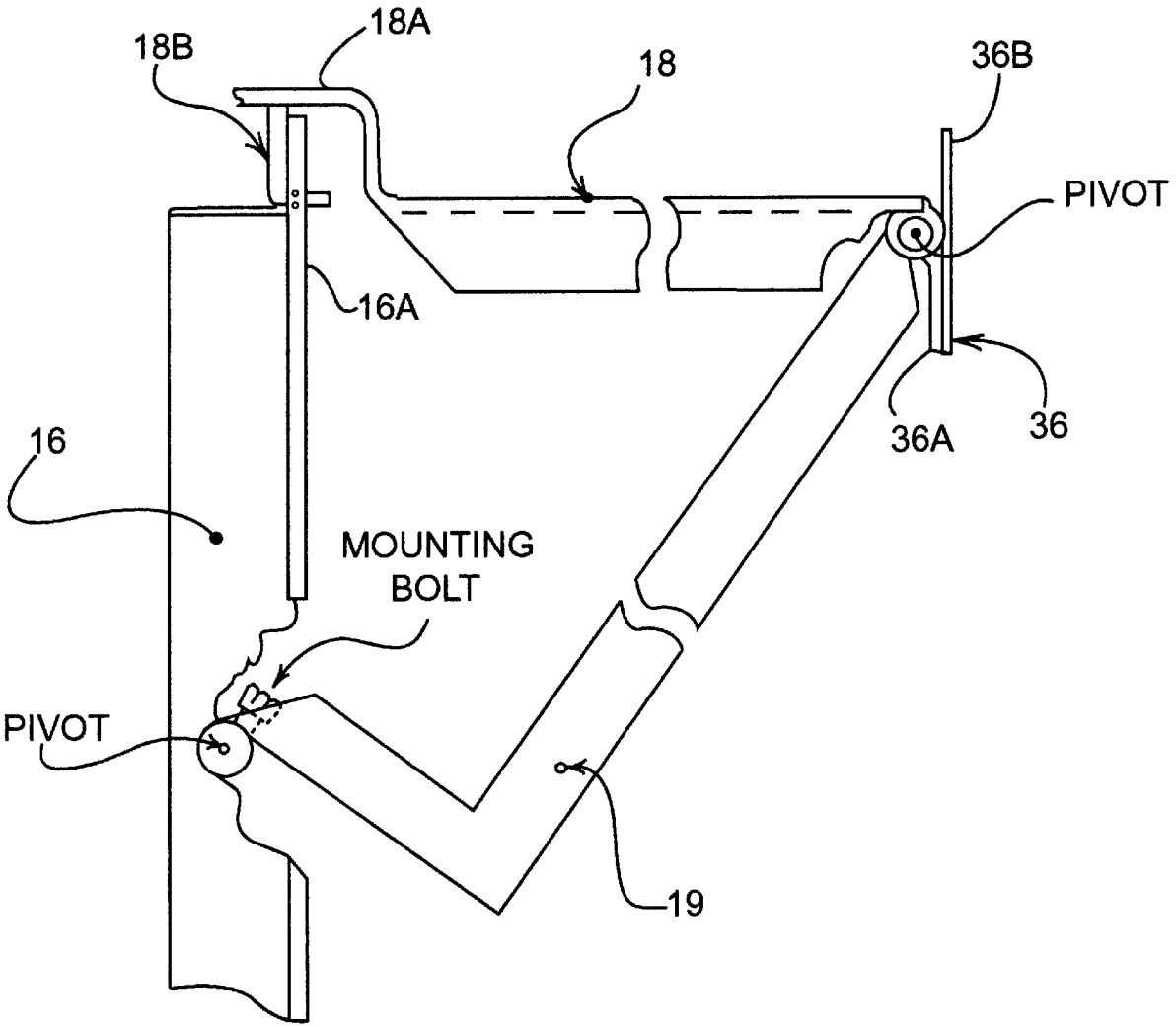
FIG. 3 is a side elevational view illustrating the upper portion of the apparatus shown in FIG. 1.

The table 18 provides a stable flat surface for supporting a workpiece (e.g., a mower, cutting reel, etc.). The table is easily adjustable between a lower and an upper position on the slide. The lower position is shown in FIG. 1, and the upper position is shown in FIGS. 2 and 3. Of course, a support means other than a table may be used in the apparatus of this invention. For example, the support means may comprise a cradle for holding and supporting a workpiece or item in a stable manner or in a particular position. As another example, the support means may comprise a number of bar members for supporting a workpiece.

The outer end of the table is pivotably connected to the outer end of a table support 19. The other end of the table support is pivotably connected to the slide. When the table is in its lower position it rests flat against the upper surface of the table support 19. To raise the table to its upper position, end 18A is simply lifted upwardly and then is attached or connected to the upper end of the slide (as shown in FIG. 3). A latch member 18B on table 18 is L-shaped and slides into a slot or opening in the slide wall 16A. The support member 19 supports the outer end of the table, as shown.

Thus, the table is stably supported on the slide 16 in either an upper or a lower position. The table surface is in a horizontal plane in both of these positions. The lower position for the table is used when the item to be lifted is on the floor or at a low level. The upper position is used when the item to be lifted on at or above bench level.

Another desirable feature of the apparatus is a roll gate 36 pivotably mounted on the outer end of the table. The outer end 36A of the roll gate is heavy and is pulled downwardly by gravity to a normal resting position as shown in FIG. 3, thereby causing end 36B to project upwardly. This prevents an item being carried on the table from rolling or sliding off the outer end. The roll gate can be pivoted to a down position (shown in FIG. 1) in order to enable an item to be rolled onto the table or to enable it to be rolled off the table at the desired location. The roll gate also functions as a bridge between the outer end of the table and a workbench, for example, when an item is being transferred to or from the workbench.

Because the elevating means can be carried within the mast, the table or support means is able to be lowered to nearly floor level and yet can be raised to a height above the top of the mast. The elevating means does not obstruct vertical travel of the table or other support means.

If desired, the lift table of the invention may include means for preventing weight overload. One such means may be a mechanical clutch (e.g. a ball detent mechanism in a gear box) which prevents the table from lifting more than a predetermined amount of weight. Another such means comprises a current sensing device 35 which measures current from the battery to the motor and shuts off the motor if the current exceeds a predetermined level. Other means may also be used to prevent the table from lifting more than a predetermined amount of weight. This is an important safety feature.

Other variants are possible without departing from the scope and intent of this invention. For example, the frame of the apparatus can be of any desired size or strength. The size and shape of the support means may also vary, as desired.

What is claimed is:

1. A portable lift table comprising:

(a) wheeled frame means including upright mast means;

(b) table means comprising:

(i) workpiece support surface having first and second ends; and (ii) a table support member having first and second ends; wherein said second end is pivotably attached to said second end of said support surface;

(c) elevating means supported by said mast means and being adapted to move said table means selectively upwardly and downwardly relative to said mast means;

wherein said first end of said support member is pivotably attached to said elevating means; and wherein said first end of said support surface is adapted to be detachably connected to said elevating means at a point above said first end of said support means.

2. A lift table in accordance with claim 1, wherein said support surface of said table means further includes a gate member pivotably attached to said support surface and being movable between a raised and a lowered position; wherein when said gate member is in said raised position a workpiece is prevented from rolling or sliding off the support surface.

3. A lift table in accordance with claim 1, further comprising means for preventing weight overload of said table means.

* * * * *